United States Patent [19]

Lequeux

[11] Patent Number: 4,507,038

[45] Date of Patent: Mar. 26, 1985

[54] BAG-COLLECTING DEVICE

[75] Inventor: Michel L. Lequeux, Wellin, Belgium

[73] Assignee: Minigrip-Belgium, Molenbeek-St. Jean, Belgium

[21] Appl. No.: 356,401

[22] Filed: Mar. 9, 1982

[30] Foreign Application Priority Data

Mar. 12, 1981 [BE] Belgium ..... 81/200275.6

[51] Int. Cl.[3] ..... B65H 33/00

[52] U.S. Cl. ..... 414/27; 414/109; 493/204; 493/226

[58] Field of Search ..... 414/27, 109; 83/95; 140/81.5; 493/186, 226, 926, 204

[56] References Cited

U.S. PATENT DOCUMENTS

| | | | |
|---|---|---|---|
| 1,968,305 | 7/1934 | Moore | 140/81.5 |
| 2,173,077 | 9/1939 | Minkel | 414/27 X |
| 2,589,899 | 3/1952 | Vail | 414/27 |
| 3,580,378 | 5/1971 | Pedersen | 198/473 X |
| 3,620,354 | 11/1971 | McMillan | 198/473 |
| 3,631,771 | 1/1972 | Schwarzkopf et al. | 414/27 X |
| 3,785,257 | 1/1974 | Tetenborg | 414/27 |

FOREIGN PATENT DOCUMENTS

| | | | |
|---|---|---|---|
| 49015 | 2/1889 | Canada . | |
| 915659 | 11/1972 | Canada . | |
| 49015 | 2/1889 | Canada . | |
| 915659 | 11/1972 | Canada . | |
| 2319690 | 11/1974 | Fed. Rep. of Germany | 493/226 |

*Primary Examiner*—James F. Coan

*Attorney, Agent, or Firm*—Cushman, Darby & Cushman

[57] ABSTRACT

There is described a device for collecting bags, to be associated with a machine for manufacturing or filling bags one by one, particularly plastic bags which are each provided along the one edge in parallel relationship with the bag-movement direction inside said machine, with a hook which projects relative to said bag and the opening of which faces the collecting device, which comprises a fixed rod facing downwards, which is arranged in the path of the bag discharged from the machine outlet and with such a spacing therefrom that said rod enters the bag hook opening when the bag is moving, the rod cross-section being smaller than the inner cross-section of said hook to let those hooks which are slipped over said rod, slide along same to have the bags pile up by gravity on the rod, means being provided on said rod with such an arrangement as to prevent the bag hooks falling by gravity from the lower free end of said rod.

9 Claims, 6 Drawing Figures

BAG-COLLECTING DEVICE

This invention has for object a bag-collecting device to be associated with a machine for manufacturing or filling bags one by one, particularly plastic bags which are each provided along the one edge in parallel relationship with the bag-movement direction inside said machine, with a hook which projects relative to said bag and the opening of which faces the collecting device.

Known collecting devices for manufacturing hook bags are comprised of a table on which pile-up the bags discharged from the machine. Said devices have the very marked drawback that the bags due to the hooks, do not pile-up accurately. As such bags are mainly intended for automatic or semi-automatic filling with goods, it is absolutely required that accurate piles be re-erected by hand for packing and conveying the bags to the various locations where they are being used. Due to the consistency of that plastic material the bags are made of, the lack of adhesion of such material, and the frequent tangling of the bag hooks, the re-erecting of bag piles is very cumbersome and it is very hard and often impossible in the case of machines with high throughput rate, for a single worker to arrange all day long, the bags manufactured by one machine into suitable piles.

The invention has for object to obviate this drawback and to provide a bag-collecting device allowing to form automatically and without any hand action, accurately-arranged bag piles and this whatever be the throughput rate of the machine. Said collecting device does not only allow to improve the working conditions of that worker packing the bag piles, but also enables a single worker to pack under good working conditions, the output from a plurality of machines.

In the handling and packing of hook bags which have been filled with goods, are encountered the same drawbacks as when handling and packing empty bags. The bag-collecting device according to the invention may also obviate when it is associated with a bag-filling machine, such drawbacks and allow an accurate piling-up of the bags.

For this purpose according to the invention, said collecting device comprises a fixed rod facing downwards, which is arranged in the path of the bag discharged from the machine outlet and with such a spacing therefrom that said rod enters the bag hook opening when the bag is moving, the rod cross-section being smaller than the inner cross-section of said hook to let those hooks which are slipped over said rod, slide along same to have the bags pile up by gravity on the rod, means being provided on said rod with such an arrangement as to prevent the bag hooks falling by gravity from the lower free end of said rod.

In an advantageous embodiment of the invention, that distance between the machine outlet and the area of the rod cooperating with the hook from the moving bag, is shorter than the distance between the hook opening and the bag edge, at right angle to the movement direction of those bags inside the machine, which leaves last of all the machine, to let that bag which has precisely been manufactured still be guided inside the machine as the rod enters the hook opening.

In another advantageous embodiment of the invention, said rod is mounted on a support which is so arranged as to have the rod position be adjustable along two directions, the one direction in parallel relationship with the bag movement direction inside the machine, to allow adapting the rod position according to the bag dimension in parallel relationship with said movement direction, and a direction at right angle to said movement direction, to allow aligning the rod and the hook openings for those bags which leave the machine.

In a particularly advantageous embodiment of the invention, said collecting device comprises a stop which that bag edge at right angle to said movement direction and leaving first the machine, meets as the bag is discharged from said machine, that spacing between the stop and the machine outlet being longer than the bag dimension in parallel relationship with said movement direction.

Other details and features of the invention will stand out from the following description given by way of non-limitative example and with reference to the accompanying drawings, in which:

FIG. 1 is a perspective view, with parts broken away, showing the bag-collecting device and the outlet of the machine for manufacturing bags it is associated with.

In the various figures, the same reference numerals pertain to similar elements.

Figure 1:
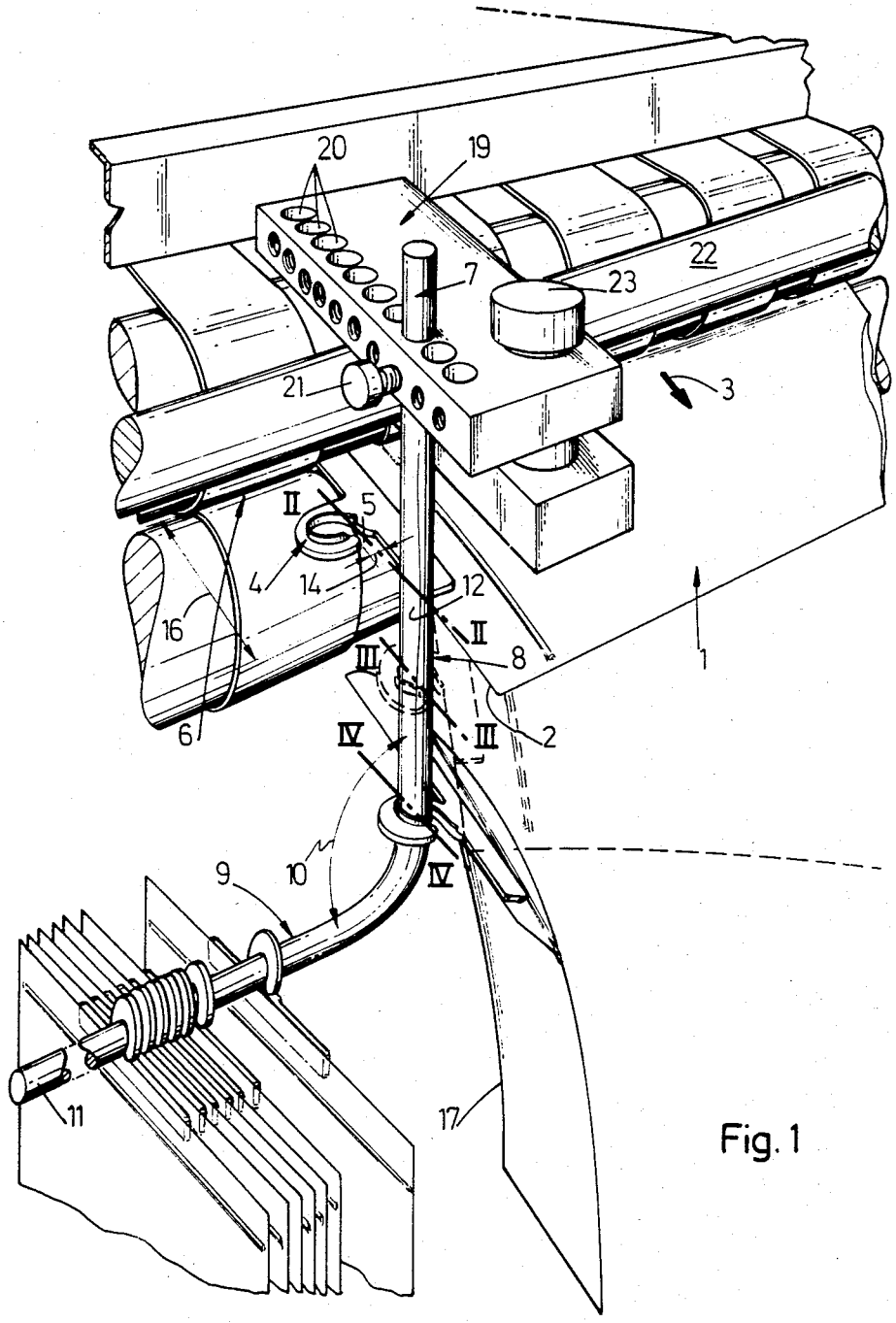
Figure 2:
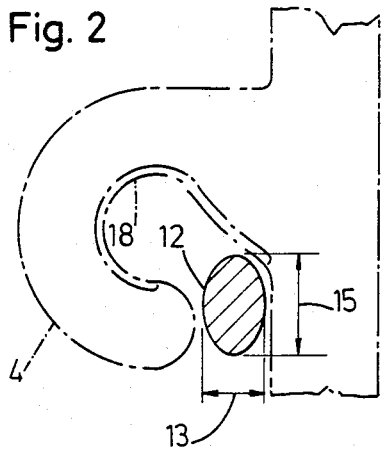
FIGS. 2, 3 and 4 are section views along lines II—II, III—III, and IV—IV in FIG. 1 and on a larger scale than FIG. 1, showing the cross-section of the first rod portion in three different locations, a bag hook being shown in dashed lines in that position it lies in as said hook cooperates with the rod portion under consideration.
Figure 4:
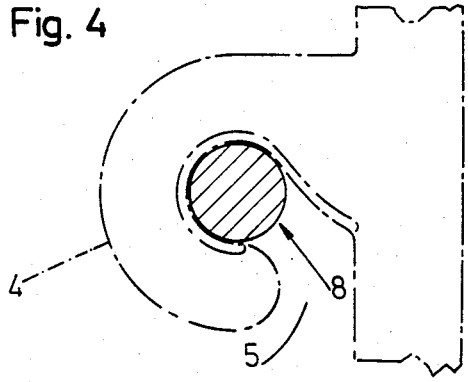
Figure 5:
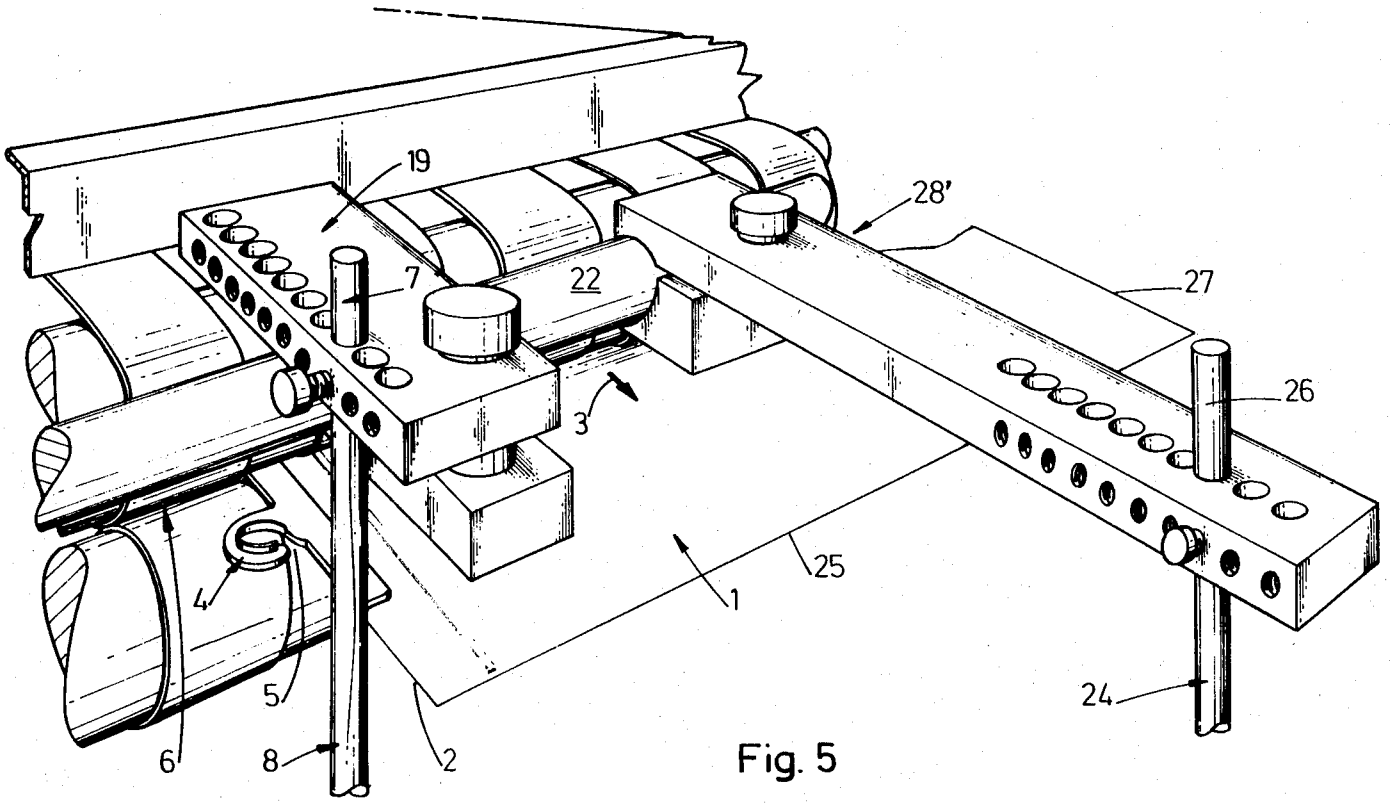
FIG. 5 is a view similar to FIG. 1, showing a variation of the collecting device shown in said FIG. 1.
Figure 6:
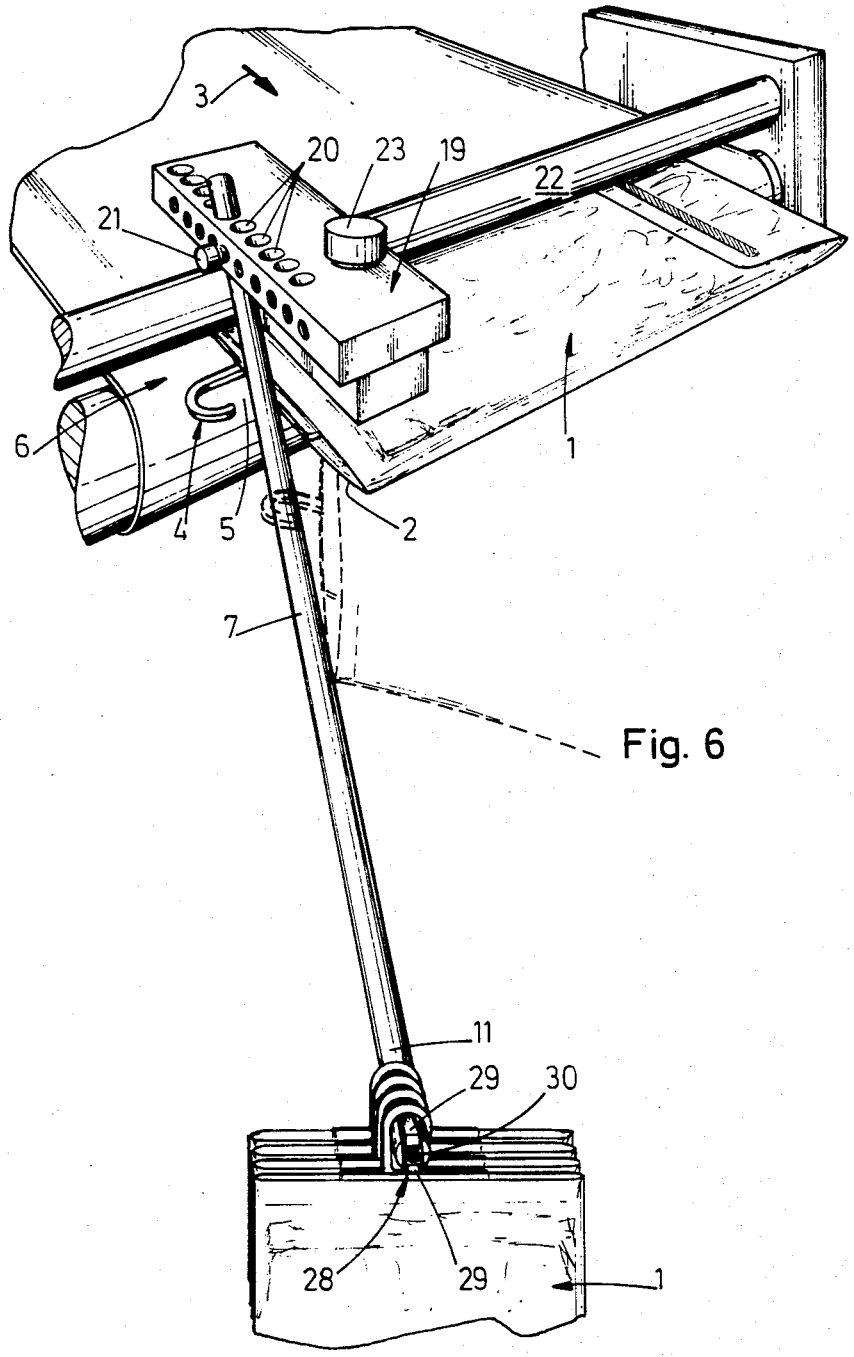
FIG. 6 is a perspective view with parts broken away, showing a bag-collecting device according to the invention as associated with a machine for filling hook bags.

The bag-collecting device according to the invention as shown in the drawings, is to be associated either with a machine for manufacturing (FIGS. 1 and 5), or a machine for filling (FIG. 6) one by one bags 1 from plastic material which are provided along the edges 2 thereof in parallel relationship with the bag movement direction inside the machine as shown by arrow 3, with a hook 4 which projects relative to the bag and the opening 5 of which faces the collecting device, the machine outlet 6 being outlined in FIGS. 1, 5 and 6. The collecting device as shown in FIGS. 1 to 5, comprises a fixed rod 7 which is comprised of a first portion 8 substantially vertical, which is arranged in the path of the hook 4 from the bag 1 being discharged from the machine to let said rod portion 8 enter the opening 5 in said bag hook when said bag moves, and a second substantially straight portion 9 which connects to portion 8 and makes therewith an angle larger than 90° to let the bags 1 released from the machine and slipped with the hooks 4 thereof over rod 7, fall down along portion 8 to form a row in line by gravity on rod portion 9. Said angle 10 is so selected as to have the bags come into line and pile up on rod portion 9 without escaping therefrom. It is thus only required to release from rod 7 a pile of accurately aligned bags, to let the hooks 4 from the bags 1 in the pile slide along rod portion 9 down to the free end 11 thereof. The area 12 from rod portion 8, provided to engage the hook 4 from that bag being discharged from the machine, the opening 5 of which has a small size, has advantageously as shown in FIG. 2, a substantially elliptic cross-section the short axis 13 of which at right angle to the movement direction 3, is shorter than dimension 14 of hook opening 5 as considered at right angle to said direction 3, the long axis 15 of the ellipse being substantially equal to the diameter of rod 7, said diameter being larger than dimension 14 while the cross-section of rod 7 outside said area 12, is at least slightly smaller than the inner cross-section of hook 4. That distance 16 between machine outlet 6 and area 12 from rod portion 8, as shown in FIG. 1, is advantageously shorter than that distance between hook opening 5 and the edge 17 of the bag which lies at right angle to said direction 3, which comes out last from the machine, in such a way that the bag which has precisely been manufactured still be guided inside said machine when area 12 from rod portion 8 enters the opening of bag hook 4.

Figure 3:
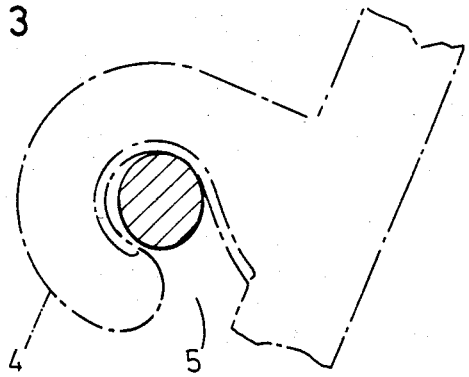

It will be noticed from FIGS. 1 to 4, that once the hook from a machine-discharged bag has been engaged on portion 8 from rod 7, said hook can no more get loose from said rod 7 as it slides therealong to come into line against those bags which have been manufactured previously. Indeed said area 12 due to the elliptic cross-section thereof, is easily engaged into the opening 5 from said hook 4 as the bag comes out of the machine, and enters the hook to bear against the inner surface 18 thereof (FIG. 2). The bag still guided inside the machine and driven thereby, swings about said area 12 from rod 7 until being expelled from said machine. As soon as it is free from the machine, the bag slides by gravity over said rod portion 8 as shown in FIG. 3, and the hook 4 thereof lies in such a position relative to rod 7 that the sizes of hook opening 5 and rod 7 in the location being considered, do not allow disengaging of said hook by letting the rod pass through the hook opening. By gravity, the bag goes on falling down rod portion 8 and reaches as shown in FIG. 4, an area where the rod cross-section is of circular shape, the diameter in said area being larger than dimension 14 of the hook opening. The rod cross-section to the exception of area 12, has a constant circle-like shape. The bag hanging from the hook thereof takes very fast a vertical attitude, in such a way that the bags come into line in a vertical position on rod portion 9.

The position of said rod 7 is adjustable relative to machine outlet 6. Said rod 7 is mounted therefor on a support 19 which is so arranged as to allow said rod to move along two directions, a first direction in parallel relationship with direction 3, to allow adjusting the rod position according to the size of the bags as considered in parallel relationship with said direction 3, and a second direction at right angle thereto to allow aligning area 12 from rod portion 8 with the openings 5 from the hooks 4 of the bags coming out of said machine. The support 19 has to allow moving rod 7 along said first direction, a series of holes 20 in line along direction 3 and regularly spaced, holes in which said rod may be engaged and locked in the required position to adjust the height of rod area 12 relative to the path of said bag hooks 4, by means of a set-screw 21. Said support 19 to allow said rod 7 moving along said second direction, may slide over a rod 22 in parallel relationship with machine outlet 6, a set-screw 23 being provided to fix in the selected position, said support 19 on rod 22.

It is of interest mostly for small-size bags, to limit the swinging of the bags about rod 7 as said rod enters the hook and the bag is discharged from the machine, to prevent the discharged bag taking such a position that it cannot return as it slides by gravity down rod portion 8 to a suitable vertical aligning position. For this purpose, the device according to the invention comprises as shown in FIG. 5, a stop 24 which edge 25 of the bag meets as said bag is discharged from the machine. Said stop is advantageously comrised of a rod 26 which extends substantially in parallel relationship with rod portion 8 with a spacing from machine outlet 6 which is longer than the bag size as considered in parallel relationship with said direction 3. Said spacing is so selected as to have said bag edge contact rod 26 after said bag having left the machine outlet and being swung about rod portion 8 over an angle smaller than 90°. The position of rod 26 is further so selected as to be further away relative to the bag being discharged from the machine, from the edge 2 of that bag the hook is associated with, than the edge 27 in parallel relationship therewith. The rod 26 is adjustable in position and it is mounted on a support 28 which is arranged on rod 22 in the same way as support 19 to allow adjusting said rod 26 along both said directions to adapt the position of said rod on the one hand according to the size of the bags in parallel relationship with direction 3, and on the other hand according to the spacing between said rod 26 and bag edge 2.

As shown in FIG. 6, the axis of rod 7 may be straight and the rod cross-section may be constant. Said rod lying at an angle downwards, allows to collect hooks 4 the opening 5 of which is substantially larger that the rod diameter and the inner cross-section of which is substantially larger than the rod cross-section. To fix the bags 1 at the free lower end 11 of said rod, the rod has means 28 comprised of two members 29 mounted on the rod through a spring 30 which brings said members into two end positions relative to the rod. In the one position, the members 29 project relative to the rod to form a stop for the hooks 4, and the other position is a retracted position allowing to disengage said hooks from the end 11 of the rod by sliding said hooks along the rod axis.

It must be understood that the invention is in no way limited to the above embodiments and that many changes may be brought therein without departing from the scope of the invention as defined in the appended claims.

For instance, the rod 7 (FIG. 6) or rod portion 8 (FIGS. 1 and 5) might be located at a distance 16 from the machine outlet 6 which is longer than that distance between the hook opening 5 and bag edge 17. This means that the bag which has precisely been manufactured by the machine will be completely discharged therefrom before the area 12 from rod portion 8 entering the opening 5 from bag hook 4. This would allow without adjusting the position of said rod 7, collecting bags the dimensions of which as considered in parallel relationship with direction 3, are different.

I claim:

1. Device for collecting bags, to be associated with a machine for manufacturing or filling bags one by one, particularly plastic bags which are each provided along the one edge in parallel relationship with the bag-movement direction inside said machine, with a hook which projects relative to said bag and the opening of which faces the collecting device, which comprises a fixed rod facing downwards, which is arranged in the path of the bag discharged from the machine outlet and with such a spacing therefrom that said rod enters the bag hook opening when the bag is moving, the rod cross-section being smaller than the inner cross-section of said hook to let those hooks which are slipped over said rod, slide along same to have the bags pile up by gravity on the rod, means being provided on said rod with such an arrangement as to prevent the bag hooks falling by gravity from the lower free end of said rod.

2. Device as defined in claim 1, in which that distance between the machine outlet and the area of the rod cooperating with the hook from the moving bag, is shorter than the distance between the hook opening and the bag edge, at right angle to the movement direction of those bags inside the machine, which leaves last of all the machine, to let that bag which has precisely been manufactured still be guided inside the machine as the rod enters the hook opening.

3. Device as defined in claim 1, in which said rod is mounted on a support which is so arranged as to have the rod position be adjustable along two directions, the one direction in parallel relationship with the bag movement direction inside the machine, to allow adapting the rod position according to the bag dimension in parallel relationship with said movement direction, and a direction at right angle to said movement direction, to allow aligning the rod and the hook openings for those bags which leave the machine.

4. Device as defined in claim 1, which further comprises a stop which that bag edge at right angle to said movement direction and leaving first the machine, meets as the bag is discharged from said machine, that spacing between the stop and the machine outlet being longer than the bag dimension in parallel relationship with said movement direction.

5. Device as defined in claim 4, in which said stop lies relative to the bag discharged from the machine, farther away from that bag edge which is associated with said hook, than that edge which is parallel thereto.

6. Device as defined in claim 5, in which said stop is mounted on a support which is so arranged as to have the stop position adjustable along two directions, the one direction in parallel relationship with the bag movement direction inside the machine, to allow adjusting the stop position according to the dimension of the bags as considered in parallel relationship with said movement direction, and the other direction at right angle to said movement direction, to adjust the spacing of said stop relation to that bag edge provided with said hook.

7. Device as defined in claim 1, in which said means preventing the bag hooks escaping from the rod lower free end, are comprised of at least one member mounted on said rod through a spring, so as to lie in two end positions relative thereto, the one position projecting relative to the rod to form a stop for the hooks, and the other position being a retracted position letting the hooks slide along the rod axis to release said hooks from the free lower end of said rod.

8. Device as defined in claim 1, in which said means preventing the bag hooks escaping from the rod free lower end are comprised of a rod portion lying at a lower level than that rod area which cooperates with the moving bag hook, the axis of which extends substantially in a horizontal plane, the bags threaded with the hooks thereof on said rod, being aligned by gravity over said rod portion without escaping therefrom.

9. Device as defined in claim 1, in which that rod area to enter the hook opening from that bag being discharged from the machine, has a substantially elliptic cross-section the short axis of which at right angle to said movement direction, is shorter than that dimension of the bag hook opening as considered at right angle to said direction, the long ellipse axis being substantially equal to the rod diameter, said diameter being longer than said opening dimension, the rod cross-section outside said area, being at least slightly smaller than the inner hook cross-section.

* * * * *